US011896105B2

(12) United States Patent
Ahn et al.

(10) Patent No.: US 11,896,105 B2
(45) Date of Patent: Feb. 13, 2024

(54) HAIR DRYER

(71) Applicant: LG ELECTRONICS INC., Seoul (KR)

(72) Inventors: Kwangwoon Ahn, Seoul (KR); Hyunjoo Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 731 days.

(21) Appl. No.: 17/076,023

(22) Filed: Oct. 21, 2020

(65) Prior Publication Data

US 2021/0353030 A1 Nov. 18, 2021

(30) Foreign Application Priority Data

May 12, 2020 (KR) ..... 10-2020-0056545

(51) Int. Cl.
*A45D 20/12* (2006.01)

(52) U.S. Cl.
CPC ..... *A45D 20/122* (2013.01)

(58) Field of Classification Search
CPC ..... A45D 20/12; A45D 20/122
See application file for complete search history.

(56) References Cited

U.S. PATENT DOCUMENTS 5,157,757 A * 10/1992 McDougall ..... A45D 20/122 239/455
5,488,783 A * 2/1996 Parkinson ..... A45D 20/122 34/283
5,671,547 A * 9/1997 Truchet ..... A45D 20/12 34/96
6,038,782 A * 3/2000 Schepisi ..... A45D 20/122 392/374
6,199,295 B1 * 3/2001 Smal ..... A45D 20/122 34/98
8,387,271 B2 * 3/2013 Shami ..... A45D 20/12 132/211
9,936,788 B2 * 4/2018 Stephens ..... A45D 20/122
10,165,844 B2 * 1/2019 Stephens ..... A45D 20/122
2012/0102775 A1 5/2012 Choi
2013/0276321 A1 10/2013 Courtney
2016/0242524 A1 * 8/2016 Floessholzer ..... A45D 20/122

FOREIGN PATENT DOCUMENTS

EP 3095346 A1 * 11/2016 ..... A45D 20/00
JP 2531800 4/1997
JP 6085841 3/2017
(Continued)

OTHER PUBLICATIONS

International Search Report issued in Application No. PCT/KR2020/012330 dated Aug. 17, 2021.
(Continued)

*Primary Examiner* — Gregory A Wilson
(74) *Attorney, Agent, or Firm* — KED & ASSOCIATES

(57) ABSTRACT

A hair dryer is provided that may include a main body including a discharge unit configured to discharge fluid outside of the main body, and a handle provided at one side of the main body. The discharge unit may include a plurality of discharge areas configured to discharge fluid. The discharge unit may be configured to selectively discharge fluid through one of the plurality of the discharge areas.

7 Claims, 12 Drawing Sheets

(56) References Cited

FOREIGN PATENT DOCUMENTS

| | | |
|---|---|---|
| KR | 10-2010-0086409 | 7/2010 |
| KR | 10-2011-0003175 | 1/2011 |
| KR | 10-1494686 | 2/2015 |
| KR | 10-2016-0052719 | 5/2016 |
| KR | 10-2016-0096888 | 8/2016 |
| KR | 10-2019-0004889 | 1/2019 |
| KR | 10-2019-0072170 | 6/2019 |
| WO | WO 94/23611 | 10/1994 |

OTHER PUBLICATIONS

International Search Report issued in Application No. PCT/KR2020/012277 dated Feb. 8, 2021.
Korean Notice of Allowance issued in Application No. 10-2020-0056546 dated Nov. 29, 2021.
U.S. Office Action dated Sep. 15, 2023 issued in U.S. Appl. No. 17/075,949.

* cited by examiner

HAIR DRYER

CROSS-REFERENCE TO RELATED APPLICATION(S)

This application claims priority to Korean Patent Application No. 10-2020-0056545, filed in Korea on May 12, 2020, the entire contents of which is hereby incorporated by reference in its entirety.

BACKGROUND

1. Field

A hair dryer is disclosed herein.

2. Background

When drying wet hair as desired or style the hair, a user may use a hair dryer configured to discharge air via an air outlet hole. Such a hair dryer may include a fan unit for blowing air. The hair dryer including such an internal structure may be designed to facilitate convenient use in consideration of its load.

Korean Registered Patent No. 10-1494686, which is hereby incorporated by reference, discloses a technique that uses a direction adjusting pipe coupled to a main body and configured to adjust a blowing direction of air discharged from the main body. As mentioned above, the user may want the air provided while having diverse blowing characteristics, such as blowing direction adjustment, depending on the situation. The hair dryer disclosed in Korean Registered Patent No. 10-1494686 has a disadvantage in that the user has to attach or detach an auxiliary direction adjusting pipe, depending on the situation.

In addition, the user may want to adjust an air blowing cross-sectional area or an air blowing speed to use the hair dryer and such demands need to be satisfied. Accordingly, it becomes an important matter to improve usability of the hair dryer by changing characteristics of the air based on user demand without providing additional elements to the main body of the hair dryer.

BRIEF DESCRIPTION OF THE DRAWINGS

Embodiments will be described in detail with reference to the following drawings in which like reference numerals refer to like elements, and wherein.

DETAILED DESCRIPTION

Description will now be given of embodiments disclosed herein, with reference to the accompanying drawings. For the sake of brief description with reference to the drawings, the same or equivalent components may be provided with the same or equivalent reference numbers, and repetitive description thereof has been omitted.

In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

Terminology that is used in the present disclosure is limited to only for embodiments herewith but made only to make it easy to understand the present disclosure.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

In the description, terms of "and/or" may include combinations of the disclosed elements or one of them. Also, "A or B" may include "A", "B" or "both of A and B".

Figure 1:
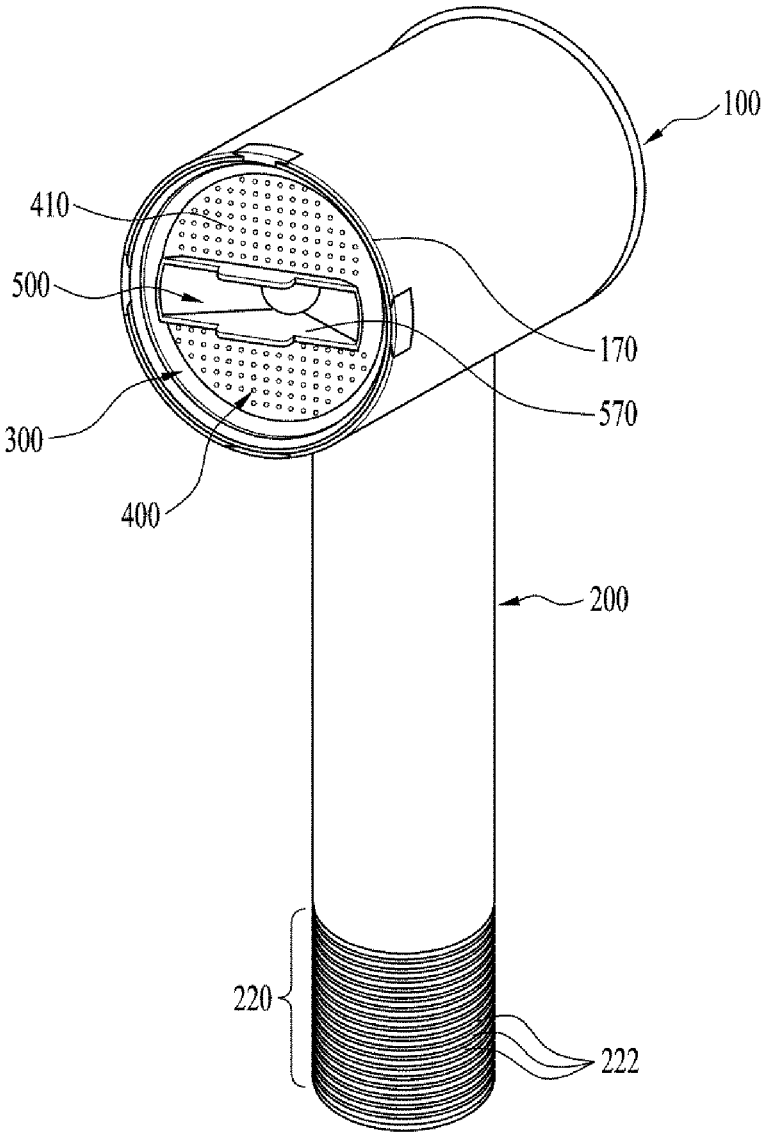
FIG. 1 is a schematic diagram of a hair dryer according to an embodiment.
Figure 2:
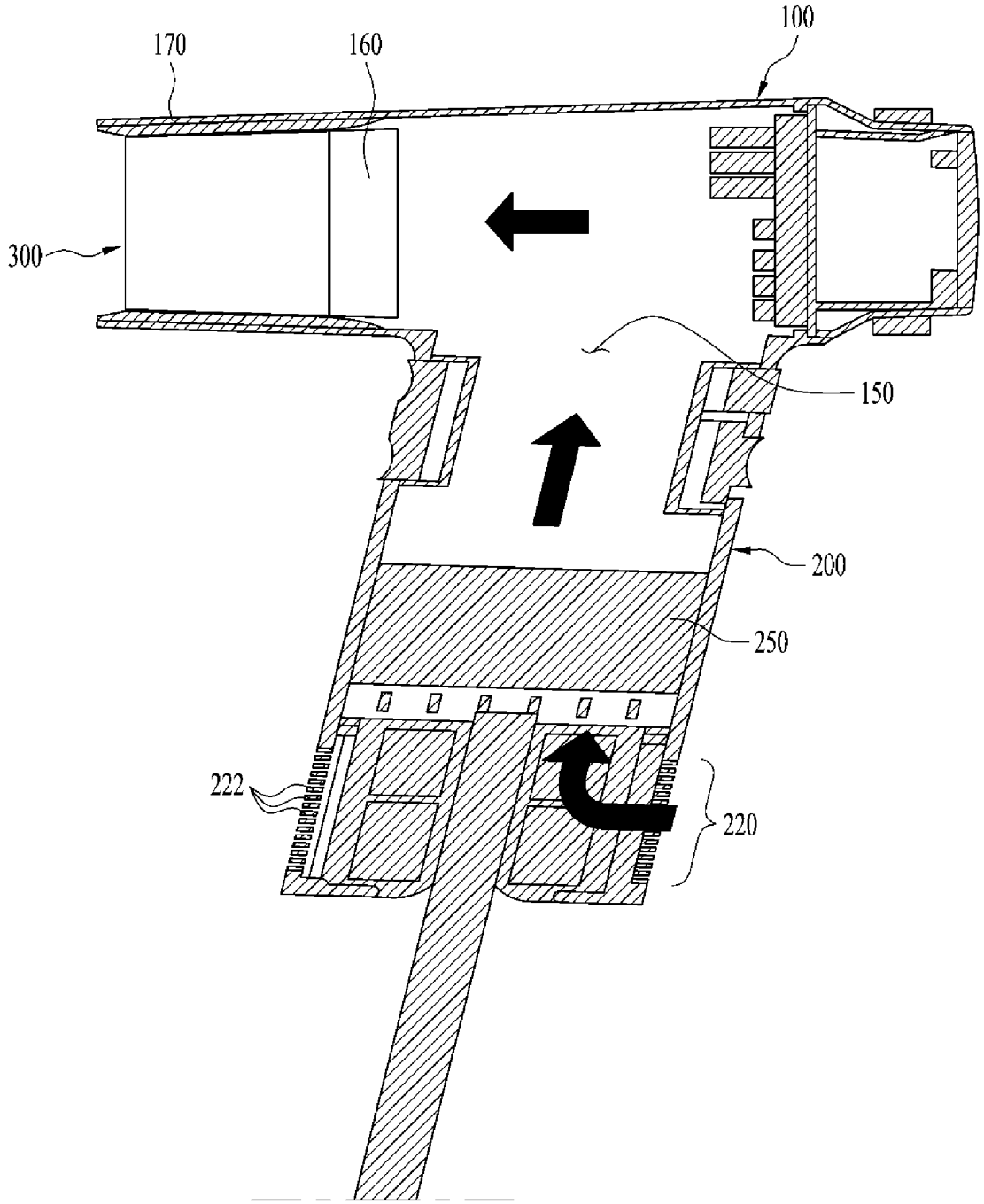
FIG. 2 is a schematic diagram illustrating an inside of the hair dryer of FIG. 1.

FIG. 1 is a schematic diagram of a hair dryer according to an embodiment. FIG. 2 is a schematic cross-sectional diagram illustrating an inside of the hair dryer of FIG. 1.

The hair dryer according to an embodiment, as shown in FIG. 1, may include a main body 100 and a handle 200. The main body 100 may include an air discharge unit 300 configured to discharge air drawn from the outside.

As shown in FIG. 2, the main body 100 may have an air path (flow path) 150 through which a gas or fluid, such as air may flow. The air path 150 may be provided in the main body 100 or may extend from the handle 200 to an inside of the main body 100. The air path 150 may be defined by the inside of the main body 100, by the inside of the main body and an inside of the handle 200, or by air that flows from an air draw unit (draw unit) 220 to the air discharge unit 300.

For example, when the air draw unit 220 is provided in the main body 100, the air path 150 may be formed in the main body 100. When air draw unit 220 is provided in the handle 200, the air path 150 may be formed in both the handle 200 and the main body 100.

The air discharge unit 300 may be provided in the main body 100 and configured to discharge the air flowing along the air path 150 outside of the main body 100. The air discharge unit 300 may have a shape that extends in parallel with an air discharge direction of the air discharge unit 300 or one of diverse cross-sectional areas including a circular or polygonal cross-sectional area.

The air flowing in the main body 100 may be drawn through the air draw unit 220. The air draw unit 220 may be provided in the main body 100 or the handle 200. When the air draw unit 220 is provided in the handle 200, as shown in FIGS. 1 and 2, the air path 150 may extend from the handle 200 to the main body 100, more specifically, from the air draw unit 220 to the air discharge unit 300. Air may be drawn through the air draw unit 220 provided in the main body 100 or the handle 200 and the drawn air may flow along the air path 150 to be discharged outside through the air discharge unit 300 provided in the main body 100.

The handle 200 may extend from the main body 100. Referring to FIGS. 1 and 2, the handle 200 may extend from one side of the main body 100 approximately in a downward direction. A longitudinal direction or axis of the handle 200 may cross a longitudinal direction or axis of the main body 100. The handle 200 may have a shape extended from the main body 100 and integrally formed with the main body 100 or fabricated as an independent component to be coupled to the main body 100.

When the handle 200 is coupled to the main body 100 as the independent component, the longitudinal direction of the handle may be fixed or variable with respect to the main body 100. For example, the handle 200 may include a hinge coupling portion to be coupled to the main body 100 and foldable with respect to the main body 100 to facilitate a variable longitudinal direction.

The handle 200 may be holdable by a user and it may be formed in various shapes capable of enhancing grip convenience. The main body 100 shown in FIGS. 1 and 2 may extend along a forward-and-backward direction, and the air discharge unit 300 may be provided in or at a front area of the extended main body. The handle 200 may have a shape that extends approximately downwardly.

The forward-and-backward direction may be defined with respect to an air discharge direction of the air discharge unit 300. In other words, the air discharge unit 300. More specifically, the air discharge unit 300 may be configured to discharge air forwardly, and the main body 100 may have the air discharge unit 300 provided in or at a front side such that a longitudinal direction or axis of the air discharge 300 extends parallel with the forward-and-backward direction.

As mentioned above, front and rear areas may be defined by the air discharge direction of the air discharge unit 300. Accordingly, the air discharge unit 300 may not necessarily be provided in the front area of the main body 100. The longitudinal direction and the forward-and-backward direction of the main body 100 may not necessarily be in parallel with each other.

Hereinafter, the front and rear areas may be defined with respect to the air discharge direction for easy description. In embodiments, the air discharge unit 300 is provided in the front area of the main body 100 and the longitudinal direction extends in parallel with the forward-and-backward direction of the main body 100.

Referring to FIG. 2, the hair dryer according to an embodiment may include a fan unit 250 configured to blow air and adjust a velocity of the air discharged through the air discharge unit 300. The fan unit 250 may be provided on the air path 150 to blow the air. Alternatively, it may be provided in the main body 100 or the handle 200.

For example, when the air draw unit 220 is arranged in the handle 200, the air path 150 may extend from the air draw unit 220 to the air discharge unit 300 of the main body 100. The fan unit 250 may be arranged in the air path 150 provided in the handle 200.

The air draw unit 220 may include a plurality of air inlet holes 222. The plurality of air inlet holes 222 may facilitate communication between the air path 150 provided in the hair dryer and an outside of the hair dryer. The air outside of the air draw unit 220 may be drawn into the air path 150 via the plurality of air inlet holes 222 of the air draw unit 220.

A temperature adjusting unit (temperature adjuster) 160 may be provided in the main body 100 to adjust a temperature of the discharged air. The temperature adjusting unit 160 may be provided in various positions in various types. FIG. 2 schematically illustrates the temperature adjusting unit 160 provided in the main body 100.

For example, the temperature adjusting unit 160 may be provided as various kinds and it may use an air heating method configured to heat air by means of heat generated by electric currents provided to a coil type resistor. A resistor of the temperature adjusting unit 160 may not necessarily be a coil type; rather, it may be one of various types configured to adjust the temperature of air by means of a thermoelectric element.

An operation method of the hair dryer according to an embodiment will be described schematically, together with air flow hereinafter.

First, the user may manipulate a power button arranged in or on the main body 100 or the handle 200. When the power button is turned on, the fan unit 250 may operate and air may be drawn into the hair dryer through the air draw unit 220.

The air drawn through the air draw unit 220 may be blown along the air path 150 towards the air discharge unit 300 by the fan unit 250 and the air discharge unit 300 may discharge the air to the user. During this process, a flowing velocity of the air flowing along the air path 150 may be adjusted and the temperature of the air maybe adjusted by the temperature adjusting unit 160.

The hair dryer according to an embodiment may include a controller. The controller may be connected with and configured to control the fan unit 250, the temperature adjusting unit 160, the power button, and a manipulation unit. Operational states of the fan unit 250 and the temperature adjusting unit 160 may be adjusted by user manipulation of the manipulation unit or automatically adjusted based on an operation mode preset in the controller.

Figure 3:
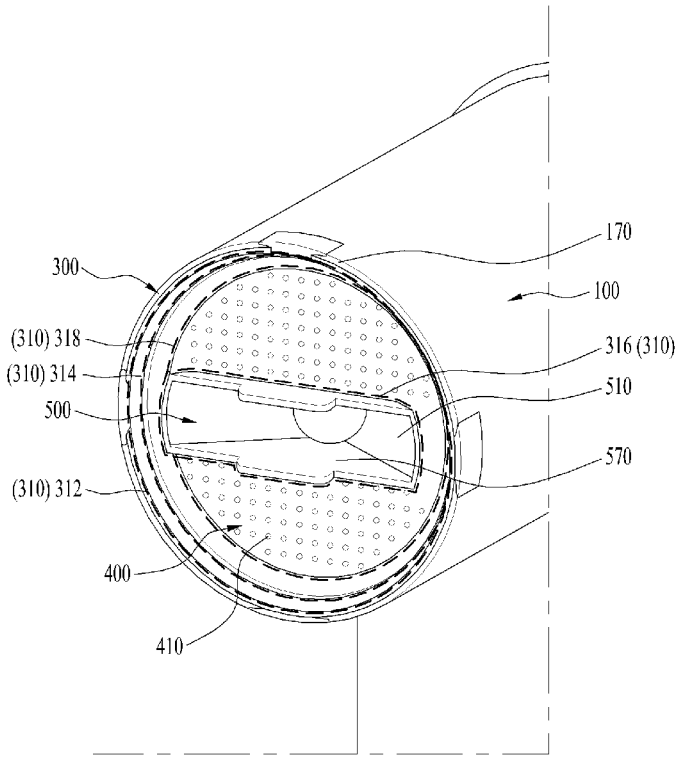
FIG. 3 is a schematic diagram illustrating an air discharge unit of the hair dryer of FIG. 1.

FIG. 3 illustrates the air discharge unit 300 provided in the main body 100 according to an embodiment, viewed from the outside. As mentioned above, the hair dryer according to an embodiment may include the main body 100 and the handle 200. The main body 100 may include the air discharge unit 300 configured to discharge air outside and the handle 200 may be provided at one side of the main body 100.

The air discharge unit 300 may include a plurality of discharge areas 310 to discharge air. Air may be discharged from one selected discharge area 310. FIG. 3 illustrates the air discharge unit 300 including the plurality of the discharge areas 310 according to one embodiment.

The discharge areas of the air discharge unit 300 may refer to areas from which air is discharged. The plurality of the discharge areas 310 may be respective separate areas. In other words, air may be selectively discharged from one of the plurality of discharge areas 310.

The plurality of the discharge areas 310 may be separated from each other as independent areas. The air discharged from respective discharge areas 310 may have different gas (fluid) characteristics.

For example, the plurality of the discharge areas 310 may have respective different air flow cross-sectional areas and diameters. Accordingly, the air discharged from the plurality of the discharge areas 310 may have respective different flow cross-sectional areas and diameters to have respective different flow shapes.

A difference between sectional areas provided in the discharge areas 310 may mean that velocities of the air discharged from the respective discharge areas 310 may be different from each other. A difference between flow cross-sectional shapes or diameters may mean that volumes of the air provided to the user is different.

In this embodiment, the air discharge unit 300 may discharge air after one of the discharge areas 310 is selected. Selection of the one out of the discharge areas 310 may be enabled by the user in various methods.

For example, the user may select one discharge area 310 using a selection button provided in the manipulation unit or the user may apply a physical change to the air discharge unit 300 to select one of the discharge areas 310. Such physical change may be made by rotating, pressing, or linearly moving at least some area of the air discharge unit 300.

The plurality of the respective discharge areas 310 according to this embodiment may have respective different gas characteristics rather than flow cross-sectional areas or diameters. The term "gas characteristics" may refer to diverse characteristics of the gas flow, such as velocity, temperature, flow cross-sectional area, flow diameter, flow cross-sectional shape, and/or stability related with turbulence, for example.

For example, one of the discharge areas 310 may have various gas characteristics in that the air provided by the temperature adjusting unit 160 is discharged to adjust the temperature of the air or the air path 150 gets narrower towards the discharge areas 310 to discharge the air more concentratedly or the air path gets wider towards the discharge area 310 to discharge the air dispersedly.

In this embodiment, although no auxiliary means for adjusting the gas characteristics is coupled to the main body 100, air may be discharged from one desired discharge area 310 by adjusting the air discharge unit 300 provided in the main body 100 so as to provide the user with air based on a purpose of use effectively.

Referring to FIG. 3, the plurality of the discharge areas 310 according to this embodiment may include an outer area 312 and an inner area 314. The outer area 312 may be provided in or at a front surface of the main body 100 and formed in a ring shape that extends along a circumference of the main body 100. The inner area 314 may be provided in the front surface of the main body 100 and at an inside of the outer area 312.

The outer area 312 and the inner area 314 may be formed in the front surface of the main body 100. The front surface of the main body 100 may be defined by the air discharge unit 300. In other words, the air discharge unit 300 may form the front surface of the main body 100.

The outer area 312 may be formed in a ring shape extending along a circumferential direction of the main body 100. In embodiments, the phrase "ring shape" may refer to a closed curve in which a closed section is formed. The ring shape may have a circular or polygonal shape. FIG. 3 illustrates the outer area 312 formed in a circular ring shape extending along the circumferential direction of the main body from the front surface of the main body 100 according to one embodiment.

The inner area 314 may be arranged in an inner area with respect to the outer area 312 in the front surface of the main body 100. In other words, the inner area 314 may be surrounded by the outer area 312. The inner area 314 may correspond to an inner closed section defined by the outer area 312.

The outer area 312 and the inner area 314 may be separated from each other and air may be discharged from one of them. The air discharged from the inner area 314 may have a wider flow cross-section than the outer area 312 such that it may provide air with a slower air velocity and a smaller diameter than the outer area 312.

The user may select one of the outer area 312 or the inner area 314 as necessity occurs, and the hair dryer according to this embodiment may discharge air through the discharge area 310 selected by the user, in other words, one of the outer and inner areas 312 and 314.

Figure 4:
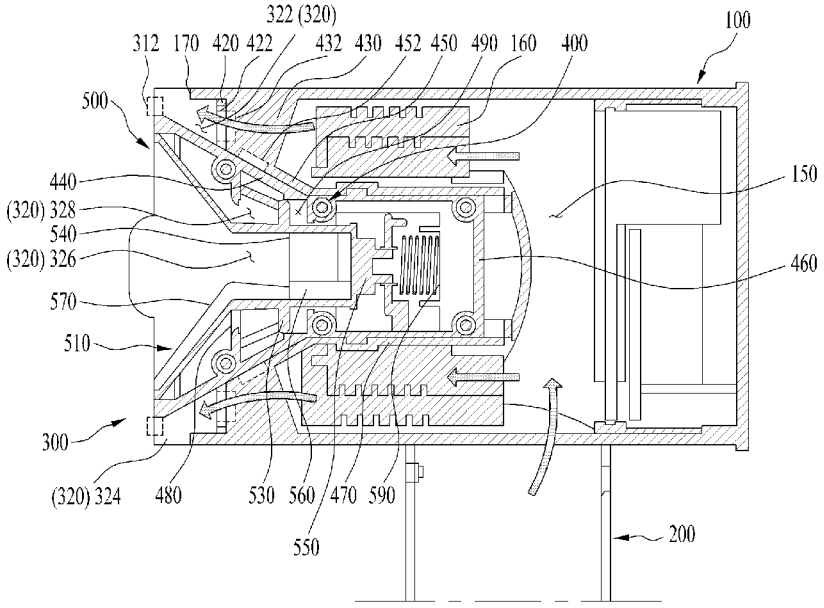
FIG. 4 is a schematic cross-sectional diagram illustrating the air discharge unit once an outer path is selected.
Figure 5:
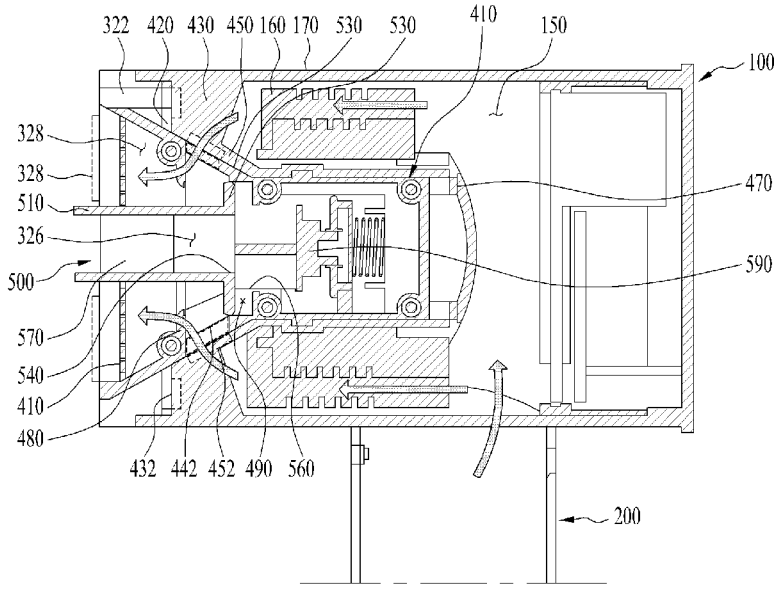
FIG. 5 is a schematic cross-sectional diagram illustrating the air discharge unit once a second inner path is selected.
Figure 6:
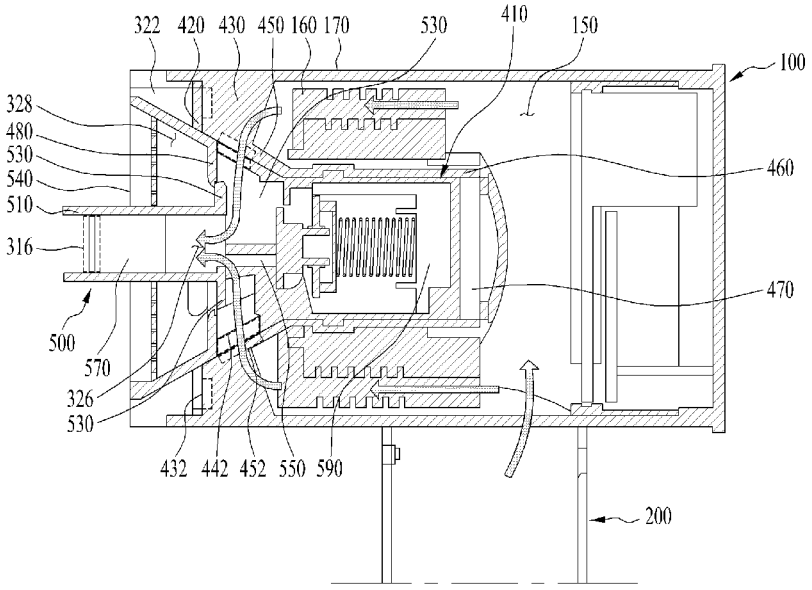
FIG. 6 is a schematic cross-sectional diagram illustrating the air discharge unit once a first inner path is selected.

FIGS. 4 through 6 illustrate cross-sectional views of an inside of the air discharge unit 300 provided in the hair dryer according to an embodiment. FIGS. 9 through 12 illustrate exploded perspective views of the air discharge unit 300.

Referring to FIGS. 4 through 6, the air discharge unit 300 according to this embodiment may include a discharge base unit (discharge base) 400. The discharge base unit 400 may be inserted into the inside of the main body 100 and a front surface 410 may form the front surface of the main body 100. The discharge base unit 400 may define a plurality of discharge paths 320 separated from each other and configured to flow air there through.

The air discharge unit 300 may be configured to blow air after one of the discharge paths 320 is selected. The discharge paths 320 may be configured to discharge air through different ones of the discharge areas 320 provided on the front surface of the main body 100.

More specifically, the discharge base unit 400 may form the front surface of the main body 100. In other words, the discharge base unit 400 may be inserted into the inside of the main body 100, that is, a front area of the main body 100, to form the front surface of the main body 100.

The main body 100 may have a shape having an open front into which the discharge base unit 400 is inserted. The discharge base unit 400 may be inserted into the main body 100 through the open front surface formed in the main body 100.

Figure 9:
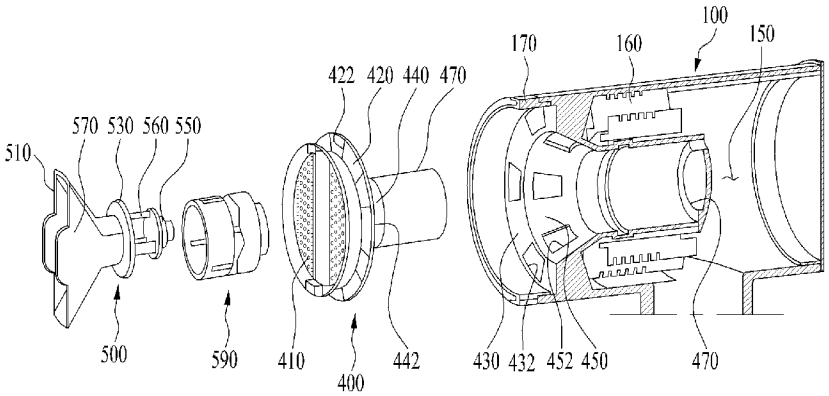
FIG. 9 is an exploded perspective diagram of the air discharge unit provided in the hair dryer.
Figure 11:
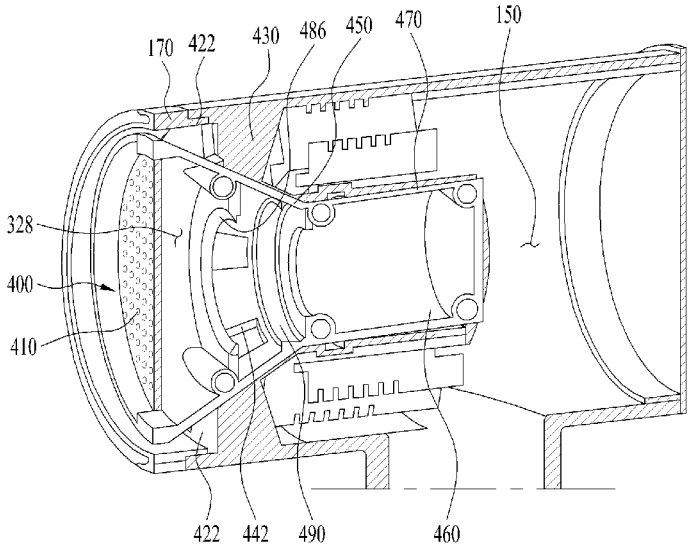
FIG. 11 is a schematic diagram illustrating a discharge base coupled to the base accommodating unit of FIG. 10.

FIG. 9 illustrates the discharge base unit 400 separated from the air discharge unit 300. FIG. 11 illustrates the discharge base unit 400 inserted into the main body 100.

The discharge base unit 400 may be configured to form a plurality of discharge paths 320. The discharge paths 320 may form respective different air flow paths. In other words, the discharge paths 320 may be separated from each other.

The discharge paths 320 may be in communication with the discharge areas 310, respectively. More specifically, the respective discharge areas 310 may correspond to respective ends of the discharge paths 320. The air discharge unit 300 may be configured to discharge the air flowing along one of the discharge paths through one of the discharge areas 310.

The air discharge unit 300 may be configured to allow the air to flow along one of the discharge paths 320. Accordingly, air may be discharged from the air discharge unit 300 through one of the discharge areas 310.

In this embodiment, the air discharge paths 320 as well as the air discharge areas 310 may be provided such that flow cross sections and shapes of the discharge areas may be different from each other. In addition, gas flow characteristics of the discharge paths 320 may be provided.

For example, one of the discharge paths 320 may be formed to have a cross-sectional area that increases towards the front surface 410 of the discharge base unit 400 and disperse the air, while decreasing the air flow velocity. Another one of the discharge paths 310 may be formed to have a cross-sectional area that decreases towards the front surface 410 while increasing the air flow velocity.

As discussed above, in this embodiment, the discharge paths 320 may be partitioned off by the discharge base unit 400 with no air exchange therebetween. Air may flow and be discharged through one of the discharge paths 320 such that air having various flow characteristics may be provided effectively.

FIG. 3 illustrates the outer area 312 and the inner area 314 provided at the front surface of the main body 100. FIG. 4 illustrates air flowing along outer path 322 configured to communicate with the outer area 312. FIGS. 5 and 6 illustrate air flowing through the inner path 324 configured to communicate with the inner area 314.

The outer area 312 according to this embodiment may surround the front surface 410 of the discharge base unit 400. The inner area 314 may be provided on the front surface 410 of the discharge base unit 400.

The outer area 312 may surround the front surface 410 of the discharge base unit 400. As described hereinafter, the outer area 312 may have an open surface that is formed between the front surface 410 of the discharge base unit 400 and outer wall 170 of the main body 100.

More specifically, the outer area 312 may be defined as an area located between the front surface 410 of the discharge base unit 400 and the outer wall 170 of the main body 100. Air may be discharged through the open surface formed in the area. The open surface may be in communication with the outer path 322 provided in the main body 100, which will be described hereinafter.

The inner area 314 may be provided in the front surface 410 of the discharge base unit 400. In other words, the inner area 314 may be formed in the front surface 410 of the discharge base unit 400. The inner area 314 may be configured to discharge air outside through the front surface 410 of the discharge base unit 400. The discharge base unit 400 may have a plurality of through-holes formed in the front surface 410, which will be described hereinafter, and air may be discharged via the through-holes.

The through-holes may be distributed in the front surface 410 uniformly such that the air discharged through the inner area 314 may have an air flow shape that is equal to the front surface 410. The inner area 314 may be divided into first inner area 316 and second inner area 318, which will be described hereinafter.

Referring to FIGS. 4 through 6, the discharge paths 320 provided in the hair dryer according to this embodiment may include outer path 322 and inner path 324. The outer path 322 may be provided between the discharge base unit 400 and the outer wall 170 of the main body 100 and configured to discharge air through the outer area 312. The inner path 324 may be provided in the discharge base unit 400 and configured to discharge air through the inner area 314 provided in the front surface 410 of the discharge base unit 400.

The outer path 322 may be provided between the discharge base unit 400 and the outer wall 170 of the main body. In other words, the outer path 322 may be defined by the outer wall of the discharge base unit 400 and the outer wall 170 of the main body 100. The outer path 322 may be connected with the outer area 312 having a front end arranged at the front surface of the main body 100 such that air may be discharged through the outer area 312.

The inner path 324 may be formed in the discharge base unit 400. A predetermined space may be formed in the discharge base unit 400 to accommodate the inner path 324. The outer path 322 and the inner path 324 may be partitioned off from each other by the outer wall of the discharge base unit 400.

The inner path 324 may have a front end connected or in communication with the inner area 314 provided at the front surface 410 of the discharge base unit 400 such that air may be discharged from the inner area 314. FIG. 5 illustrates the outer path 322 and the inner path 324 that are divided by the discharge base unit 400.

The air discharge unit 300 according to an embodiment may be configured to discharge air when one of the outer and inner areas 312 and 314 is selected based on displacement of the discharge base unit 400. More specifically, the user may manipulate the discharge base unit 400 to displace the discharge base unit 400. The discharge base unit 400 may allow the outer area 312 or the inner area 314 to be selected based on the displacement. In other words, the discharge base unit 400 may be configured to allow air flow after the outer path 322 or the inner path 324 is selected based on the displacement.

The discharge base unit 400 may be rotatable in a circumferential direction of the main body 100 and configured to allow one of the outer and inner areas 312 and 314 to be selected based on a rotational position. More specifically, the discharge base unit 400 may be rotatable in the circumferential direction of the main body 100 and configured to allow air flow along one of the outer and inner paths 322 and 324 based on the rotational position.

The discharge base unit 400 may be rotatably accommodated in the main body 100. Accordingly, the user may rotate the discharge base unit 400, if necessary. The discharge base unit 400 may be configured to flow and discharge air after one of the outer and inner areas 312 and 314, in other words, one of the outer and inner paths 322 and 324 is selected based on the rotational position.

In addition, when the discharge base unit 400 is rotational to a second position which is different from a first position, the air path 150 provided in the main body 100 may communicate with the inner path 324. The first position and the second position may have various differences based on angles. For example, when rotated 90 degrees from the first position, the discharge base unit 400 may be located in the second position. A difference between rotational angles of the first and second positions may be preset or predetermined, such as 30 degrees, 45 degrees, and 60 degrees, for example.

A communication relationship between rotational positions of the discharge base unit 400 and the air path 150 may be determined by the opening-and-closing unit. The opening-and-closing unit may include a first outer opening-and-closing portion 420, a second outer opening-and-closing portion 430, a first inner opening-and-closing portion 440, and a second inner opening-and-closing portion 450.

FIG. 4 illustrates that the air path 150 of the main body 100 is in communication with the outer path 322. FIGS. 5 and 6 illustrate that the air path 150 of the main body 100 is in communication with the inner path 324.

Referring to FIGS. 5 and 6, the air discharge unit 300 according to an embodiment may include first outer opening-and-closing portion 420 and second outer opening-and-closing portion 430. The first outer opening-and-closing portion 420 may protrude from the discharge base unit 400 towards the outer wall 170 of the main body 100 and extend along the circumferential direction to surround the discharge base unit 400. A first outer hole 422 may be formed in the air discharge unit 300.

The outer opening-and-closing portion 430 may be provided in the main body 100 and adjacent to the first outer opening-and-closing portion 420. Also, it may extend along the circumferential direction to surround the discharge base unit 400 and contact with the first outer opening-and-closing portion 420. A second outer hole 432 may be formed. The discharge base may rotate to allow a predetermined area of the first outer hole 422 to overlap with the second outer hole 432 such that air may flow through the outer path 322.

More specifically, the first outer opening-and-closing portion 420 and the second outer opening-and-closing portion 430 may be provided between the outer wall of the discharge base unit 400 and the outer wall 170 of the main body 100. In other words, the first outer opening-and-closing portion 420 and the second outer opening-and-closing portion 430 may be provided on the outer path 322 to cross the outer path 322.

The first outer opening-and-closing portion 420 and the second outer opening-and-closing portion 430 may be formed in a ring or disc shape that extends along the circumferential direction of the main body 100 or the discharge base unit 400. Accordingly, the first outer opening-and-closing portion 420 and the second outer opening-and-closing portion 430 may be formed in the shape that closes the outer path 322.

The first outer opening-and-closing portion 420 may be provided in the discharge base unit 400 and rotatable together with the discharge base unit 400. The first outer opening-and-closing portion 420 may extend from the discharge base unit 400 to the outer wall 170 of the main body 100. The first outer opening-and-closing portion 420 may be integrally formed with the discharge base unit 400 or fabricated as an auxiliary element to be coupled to the discharge base unit 400.

The second outer opening-and-closing portion 430 may be provided on an inner circumferential surface of the outer wall 170 which is directed toward the discharge base unit 400 and its position may be fixed. The second outer opening-and-closing portion 430 may extend from an inner circumferential surface of the main body 100 towards the outer wall of the discharge base 400. The second outer opening-and-closing portion 430 may be integrally formed with the outer wall 170 of the main body 100 or fabricated as an auxiliary element to be coupled to the main body 100.

The first outer hole 422 may penetrate the first outer opening-and-closing portion 420 along an extending direction of the outer path 322. The second outer hole 432 may penetrate the second outer opening-and-closing portion 430 along an extending direction of the outer path 322.

The first outer opening-and-closing portion 420 and the second outer opening-and-closing portion 430 may be arranged adjacent to each other along the forward-and-backward direction. For example, one surface of the first outer opening-and-closing portion 420 and one surface of the second outer opening-and-closing portion 430 that face each other may be in close contact.

Although FIGS. 4 through 6 illustrate that the first outer opening-and-closing portion 420 is arranged in front of the second outer opening-and-closing portion 430, positions are not limited. That is, the first outer opening-and-closing portion 420 may be arranged behind the second outer opening-and-closing portion 430.

Figure 10:
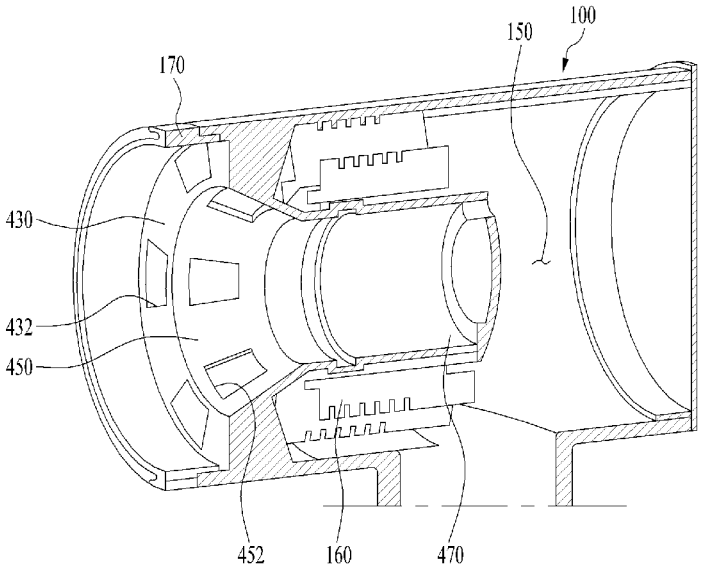
FIG. 10 is a schematic diagram illustrating a base accommodating unit of the hair dryer.

In addition, FIG. 10 illustrates the second outer opening-and-closing portion 430 that is provided in the main body 100 according to one embodiment. FIG. 11 illustrates the first outer opening-and-closing portion 420 provided in the discharge base unit 400.

The air discharge unit 300 may discharge air toward the outer path 322, when the discharge base unit 400 is rotated to allow communication between the first outer hole 422 and the second outer hole 432.

Referring to FIGS. 4 through 6, the configuration will be described as follows. FIG. 4 illustrates a state in which the first outer hole 422 and the second outer hole 432 are arranged to face each other, in other words, the holes may communicate with each other.

The first outer opening-and-closing portion 420 having the first outer hole 422 formed therein may be rotatable together with the discharge unit 400. As shown in FIGS. 5 and 6, air may be prevented from flowing to the outer path 322 by the first outer opening-and-closing portion 420 and the second outer opening-and-closing portion 430, in a state in which the first outer hole 422 and the second outer hole 432 are spaced apart along the circumferential direction of the main body 100, without overlapping with each other.

In a state where the first outer hole 422 and the second outer hole 432 are located to communicate with each other, the air path 150 and the outer path 322 provided in the main body 100 may communicate with each other via the first outer hole 422 and the second outer hole 432 such that air may flow through outer path 322.

Figure 7:
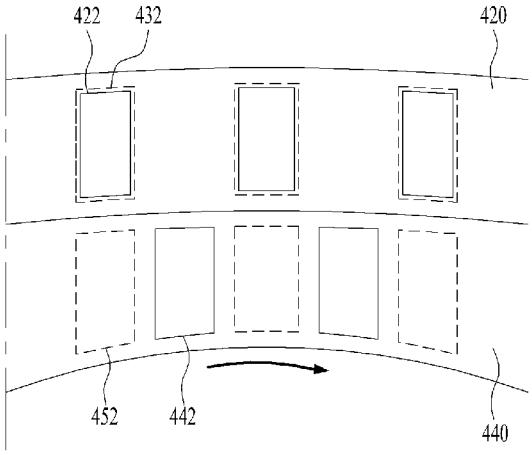
FIG. 7 is a schematic diagram illustrating a rotational state of an opening and closing portion when the outer path is selected in the hair dryer.
Figure 8:
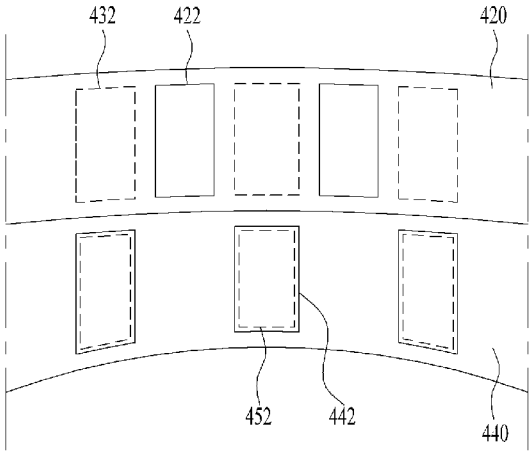
FIG. 8 is a schematic diagram schematically illustrating a rotational state of the opening and closing portion when the inner path is selected in the hair dryer.

FIGS. 7 and 8 schematically illustrate the position relation between the first outer opening-and-closing portion 420 and the second outer opening-and-closing portion 430. FIG. 7 schematically illustrates that the discharge base unit 400 is rotated to allow the first outer hole 422 and the second outer hole 432 to face each other. FIG. 8 schematically illustrates that the discharge base unit 400 is rotated to allow the first and second outer holes 422 and 432 to be spaced apart from each other along the circumferential direction.

The air discharge unit 300 may further include a first inner opening-and-closing portion 440 and a second inner opening-and-closing portion 450. The first inner opening-and-closing portion 440 may extend along the circumferential direction to form at least a predetermined area of the discharge base unit 400. A first inner hole 442 may be formed in the first inner opening-and-closing portion 440 to facilitate communication between the outside of the discharge base unit 400 and the inner path 324.

The second inner opening-and-closing portion 450 may be provided in the main body 100 and adjacent to the first inner opening-and-closing portion 440. The second inner opening-and-closing portion 450 may extend along the circumferential direction to surround the discharge base unit 400 and be in contact with the first inner opening-and-closing portion 440. A second inner hole 452 may be formed in the second inner opening-and-closing portion 450. FIG. 10 illustrates the second inner opening-and-closing portion 450 according to one embodiment and FIG. 11 illustrates the first inner opening-and-closing portion 440.

The first inner opening-and-closing portion 440 and the second inner opening-and-closing portion 450 may be formed in a ring or disc shape extending along the circumferential direction of the main body 100 or discharge base unit 400. The first inner opening-and-closing portion 440 may form at least a predetermined area of the discharge base unit 400.

For example, as shown in FIG. 11, the discharge base unit 400 according to one embodiment may have some area of the outer wall that corresponds to the first inner opening-and-closing portion 440. In other words, the discharge base unit 400 may have the first inner opening-and-closing-portion 440 provided in the outer wall.

The first inner hole 442 may be formed in the first inner opening-and-closing portion 440. Accordingly, the inside and the outside of the discharge base unit 400 may be in communication with each other by the first inner hole 442. In other words, the inner path 324 provided in the discharge base unit 400 may be selectively in communication with the outside, for example, the air path 150 of the main body 100 via the first inner hole 442.

A shape and number of the first inner holes 442 may be variable. FIG. 11 illustrates that the first inner holes 442 are spaced apart from each other along the circumferential direction according to one embodiment.

The second inner opening-and-closing portion 450 may be provided in the main body 100 and face the first inner opening-and-closing portion 440. For example, the second inner opening-and-closing portion 450 may be secured in the main body 100 to locate one surface in close contact with the first inner opening-and-closing portion 440.

The second inner opening-and-closing portion 450 may be connected with the second outer opening-and-closing portion 430 or fabricated as independent element and secured in the main body 100. The second inner opening-and-closing portion 450 may include the second inner hole 452 configured to allow the inner path 324 to selectively communicate with the air path 150 provided in the main body 100.

The first inner opening-and-closing portion 440 and the second inner opening-and-closing portion 450 may be arranged between the air path 150 and the inner path 324 and configured to shut off the inner path 324. The discharge base unit 400 may be rotated to overlap at least a predetermined area of the first inner hole 442 with the second inner hole 452 such that air may flow through the inner path 324.

FIG. 4 illustrates that the first outer hole 422 and the second outer hole 432 face each other to facilitate communication between the outer path 322 and the air path 150. Also, it illustrates that the first inner hole 442 and the second inner hole 452 may be spaced apart from each other along the circumferential direction to close the inner path 324 from the air path 150.

FIGS. 5 and 6 illustrate that the first outer hole 422 and the second outer hole 432 are spaced apart from each other along the circumferential direction to close the outer path 322 from the air path 150 and that the first inner hole 442 and the second inner hole 452 are located to face each other and facilitate communication between the inner path 324 and the air path 150 with each other.

In this embodiment, one of the outer and inner paths 322 and 324 is selected and air may flow in the selected path. Accordingly, when one of the outer and inner paths 322 and 324 is in communication with the air path 150 provided in the main body 100, the other one may be closed off from the air path 150. Such selection may be preset based on the positional relationship among the first outer hole 422, the second outer hole 432, the first inner hole 442 and the second inner hole 452, which will be described hereinafter, referring to FIGS. 7 and 8.

The first outer opening-and-closing portion 420 having the first outer hole 422 and the first inner opening-and-closing portion 440 having the first inner hole 442 may form at least a predetermined area of the discharge base unit 400 or be coupled to the discharge base unit 400 to be rotatable together with the discharge base unit 400.

FIG. 7 illustrates that the first outer hole 422 and the second outer hole 432 are arranged to face each other and that the first inner hole 442 and the second inner hole 452 are spaced apart from each other along the circumferential direction. The first outer hole 422 and the first inner hole 442 may be provided not to be in parallel with each other along the forward-and-backward direction, in other words, the air discharge direction. In other words, the first outer hole 422 may be spaced apart from the first inner hole 442 in the circumferential direction.

The second outer hole 432 and the second inner hole 452 may be in parallel with each other along the forward-and-backward direction. Accordingly, when the first outer hole 422 and the second outer hole 432 are located to face each other, the first inner hole 442 and the second inner hole 452 may be spaced apart from each other along the circumferential direction.

In contrast, the first outer hole 422 and the second outer hole 432 may be arranged in parallel along the forward-and-backward direction. The first inner hole 442 and the second inner hole 452 may be spaced apart from each other along the circumferential direction.

Hereinafter, the first outer hole 422 and the second outer hole 432 are spaced apart from each other along the circumferential direction and the first inner hole 442 and the second inner hole 452 are arranged in parallel with each other along the forward-and-backward direction as shown in FIGS. 7 and 8 for easy description.

FIG. 7 illustrates that the first outer hole 422 and the second outer hole 432 are arranged to face each other to facilitate communication between the outer path 322 and the air path 150 and that the first inner hole 442 and the second inner hole 452 are spaced apart from each other to space the inner path 324 and the air path 150 apart from each other.

The communication relationship corresponding to FIG. 7 is shown in FIG. 4. Referring to FIG. 4, the discharge base unit 400 according to an embodiment may be provided in the air path 150. The first outer opening-and-closing portion 420 and the second outer opening-and-closing portion 430 may be arranged between the outer path 322 and the air path 150. The first inner opening-and-closing portion 440 and the second inner opening-and-closing portion 450 may be arranged between the air path 150 and the inner path 334.

As shown in FIG. 4, the air path 150 may be provided between the discharge base unit 400 and the outer wall 170 of the main body 100 behind the first outer opening-and-closing portion 420 and the second outer opening-and-closing portion 430. The outer path 322 may be arranged between the discharge base unit 400 and the outer wall 170 of the main body 100 and in front of the first outer opening-and-closing portion 420 and the second outer opening-and-closing portion 430.

As shown in FIG. 4, the discharge base unit 400 may be rotated to facilitate communication between the first outer hole 422 and the second outer hole 432 to facilitate communication between the air path 150 and the outer path 322.

The first inner hole 442 and the second inner hole 452 may be spaced apart from each other to space the airpath 150 and the inner path 324 apart from each other.

FIG. 4 illustrates a state in which the first inner hole 442 and the second inner hole 452 face each other while the discharge base unit 400 is rotated to space the first outer hole 422 apart from the second outer hole 432. Accordingly, the outer path 322 may be closed from the air path 150 and the inner path 324 may be in communication with the air path 150.

The communication relationship corresponding to FIG. 8 may be FIGS. 5 and 6. Referring to FIGS. 5 and 6, the first inner opening-and-closing portion 440 and the second inner opening-and-closing portion 450 may be arranged between the air path 150 and the inner path 324. The air path 150 may be provided in or at an outer area of the first and second inner opening-and-closing portions 440 and 450. The inner path 324 may be provided in or at an inner area of the first and second inner opening-and-closing portions 440 and 450.

As shown in FIGS. 5 and 6, the discharge base unit 400 may be rotated to space the first outer hole 422 and the second outer hole 432 apart from each other and close the outer path 322 from the air path 150. Also, the first inner hole 442 and the second inner hole may be in communication with each other to facilitate communication between the inner path 324 and the air path 150.

As discussed above, the air discharge unit 300 according to an embodiment may be configured to overlap at least a predetermined area of the first inner hole 442 with the second inner hole 452 in a state in which the first outer hole 422 is closed by the second outer opening-and-closing portion 430 and overlap at least a predetermined area of the first outer hole 422 with the second outer hole 432 in a state in which the first inner hole 442 is closed by the second inner opening-and-closing portion 450. More specifically, the air discharge unit 300 according to an embodiment may be rotated to facilitate communication between the inner path 324 or the outer path 322 and the air path 150 of the main body 100 such that air may be discharged through the outer area 312 or the inner area 314 of the discharge area 310.

The air discharge unit 300 according to an embodiment may further include a base accommodating portion 470 and a rotation coupling portion 460. The base accommodating portion 470 may be fixed in the main body 100. The rotation coupling portion 460 may be provided in or at a rear end of the discharge base unit 400 to be rotatably coupled to the base accommodating portion 470.

FIGS. 9 and 10 illustrate the base accommodating portion 470 fixedly provided in the main body 100 according to an embodiment. FIGS. 9 and 11 illustrate the rotation coupling portion 460 configured to be rotatably coupled to the base accommodating portion 470 so as to be accommodated therein.

The base accommodating portion 470 may be fixed in the main body 100. The base accommodating portion 470 may be integrally formed with the second outer opening-and-closing portion 430 and the second inner opening-and-closing portion 450 or fabricated as independent component.

The base accommodating portion 470 may have a predetermined space into which the rotation coupling portion 460 may be inserted. A front surface of the base accommodating portion 470 may be open to facilitate the inserting of the rotation coupling portion 460. The base accommodating portion 470 may be spaced apart from the outer wall 170 of the main body 100 and a portion of the air path 150 may be formed with the outer wall 170 of the main body therebetween.

The rotation coupling portion 460 may correspond to a portion of the discharge base unit 400. The rotation coupling portion 460 may be integrally formed with the discharge base unit 400 or fabricated as independent component to be coupled to the discharge base unit 400.

The rotation coupling portion 460 may be rotatably coupled to the base accommodating portion 470. A bearing may be provided between the rotational coupling portion 460 and the base accommodating portion 470. The rotation coupling portion 460 may be rotatable by the user or a motor. The discharge base unit 400 may be configured to be rotated on the rotation coupling portion 460 along the circumferential direction of the main body 100, as the rotation coupling portion 460 is rotatably inserted in the base accommodating portion 470.

Referring to FIGS. 10 and 11, the rotation coupling portion 460 according to an embodiment may be provided at a rear side of the discharge base unit 400 and inserted into the base accommodating portion 470 through the open front. Referring to FIG. 10, the second outer opening-and-closing portion 430 according to an embodiment may extend to the outer wall 170 of the main body 100. The second inner opening-and-closing portion 450 may extend from the second outer opening-and-closing portion 430. The base accommodating portion 470 may be connected with the second inner opening-and-closing portion 450 and secured in the main body 100.

The first outer opening-and-closing portion 420 and the second outer opening-and-closing portion 430 may be provided in parallel with the front surface of the main body 100. Diameters of the first inner opening-and-closing portion 440 and the second inner opening-and-closing portion 450 may increase towards a front side.

The second outer opening-and-closing portion 430 may extend from an inner circumferential surface of the main body 100 and the second inner opening-and-closing portion 450 may extend from an end of the second outer opening-and-closing portion 430. The base accommodating portion 470 may be connected with one end of the second inner opening-and-closing portion 450.

The outer wall 170 of the main body 100, the second outer opening-and-closing portion 430, the second inner opening-and-closing portion 450, and the base accommodating portion 470 may be integrally formed with each other or fabricated as independent components to form a mutual coupling relation. The second outer opening-and-closing portion 430, the second inner opening-and-closing portion 450, and the base accommodating portion 470 may be secured in the main body 100 by a mutual connection relationship, even without the fixing means.

As discussed above, the air draw unit 220 according to an embodiment may be provided in the handle 200 and configured to draw in external air. The air path 150 may extend from the air draw unit 220 to the air discharge unit 300. The fan unit 250 may be provided in the handle 200 and arranged in the air path 150. As the fan unit 250 and the air draw unit 220 are provided in the handle 200, the space for accommodating the discharge base unit 400 and the base accommodating portion 470 may be secured effectively.

As shown in FIGS. 4 through 6, the hair dryer according to an embodiment may include the temperature adjusting unit 160. The temperature adjusting unit 160 may be provided between the rotation coupling portion 460 and the outer wall 170 of the main body 100 to adjust the temperature of the air. More specifically, the temperature adjusting unit 160 according to an embodiment may be provided in the air path 150 connected with the plurality of the discharge paths 320, not in one of the plurality of discharge paths 320. Accordingly, the temperature of the air flowing through the respective discharge paths 320 may be adjusted.

As shown in FIGS. 4 through 6, the temperature adjusting unit 160 may be provided on an outer circumferential surface of the base accommodating portion 470 according to an embodiment. Accordingly, space utilization may be improved.

Inner area 314 may include a first inner area 316 and a second inner area 318. The first inner area 316 may be located at a center of the front surface 410 provided in the discharge base unit 400. The second inner area 318 may be provided at the front surface 410 and surround the first inner area 316. The air discharge unit 300 may be configured to discharge air through one selected from the outer area 312, the inner area 316, and the second inner area 318.

FIG. 3 illustrates that the outer area 312, the second inner area 318, and the first inner area 316 are arranged in order. The inner area 314 may be provided at the front surface 410 of the discharge base unit 400. The first inner area 316 may be provided at the center of the front surface 410. The second inner area 318 may be corresponding to the area of the front surface 410, except the first inner area 316.

Accordingly, the first inner area 316 may be surrounded along the circumferential direction of the main body 100 by the second inner area 318. The first inner area 316 and the second inner area 318 may be surrounded by the outer area 312.

The first inner area 316 may be surrounded by the second inner area 318 in the center of the front surface 410, so as to discharge the air through a smallest cross-sectional area with increased flow velocity out of the plurality of discharge areas 310. The user may select one of the outer areas 312, the first inner area 316, and the second inner area 318 based on a purpose and adjust the air discharge unit 300 so as to discharge air, In addition, like the plurality of the discharge areas 310, the inner path 324 according to an embodiment may include first inner path 326 and second inner path 328. The air discharge unit 300 may be configured to direct air along one of the outer path 322, the first inner path 326, and the second inner path 328 which is selected. The first inner path 326, the second inner path 328, and the outer path 322 may be configured to have respective different air flow characteristics such that the user may be provided with air discharged with different gas characteristics.

In the embodiment shown in FIGS. 5 and 6, the first inner area 316 or the second inner area 318 is selected in a state in which the inner area 314 is selected by the discharge base unit 400 such that air may be discharged through the air discharge unit 300. More specifically, the air discharge unit 300 may be configured to allow one of the outer and inner areas 312 and 314 to be selected from the discharge areas 310 and then one of the first and second inner areas 316 and 318 again in a state in which the inner area 314 is selected. Similarly, the air discharge unit 300 may be configured to allow one of the outer and inner paths 322 and 324 to be selected from the discharge paths 320 and then one of the first and second inner paths 326 and 328 to be selected again in a state in which the inner path 324 is selected.

According to an embodiment, the air discharge unit 300 may further include an inner selecting unit (inner selector) 500. The inner selecting unit 500 may be inserted into the discharge base unit 400 and a front end 510 of the inner selecting unit 500 may be exposed to the front of the main body 100.

The first inner path 326 may be formed in the inner selecting unit 500. The second inner path 328 may be formed between the inner selecting unit 500 and the discharge base unit 400. The first inner area 316 may be provided at the front end 510 of the inner selecting unit 500 and the second inner area 318 may be provided at the front surface 410 of the discharge base unit 400.

Figure 12:
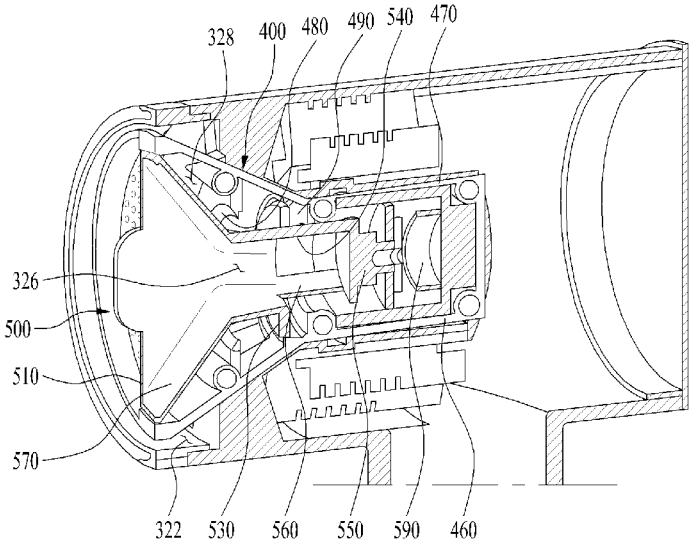
FIG. 12 is a schematic diagram illustrating an inner selection unit that is coupled to the discharge base of FIG. 11.

FIG. 9 illustrates inner selecting unit 500 according to an embodiment. FIG. 12 illustrates the inner selecting unit 500 inserted into the discharge base unit 400 according to an embodiment.

The inner selecting unit 500 may be inserted into the discharge base unit 400 and the front end 510 may be arranged at the front surface 410 of the discharge base unit 400 to be exposed to the front. The first inner path 326 may be formed in the inner selecting unit 500 and the first inner area 316 may be located at the front end 510 to discharge air from the first inner path 326.

The second inner path 328 may be formed between the inner selecting unit 500 and the discharge base unit 400. In other words, the first inner path 326 and the second inner path 328 may be partitioned off from each other by an outer wall of the inner selecting unit 500.

The second inner path 328 may be formed between the inner selecting unit 500 and the outer wall of the discharge base unit 400, and the second inner area 318 in communication with the second inner path 328 may correspond to the area of the discharge base unit 400, except for the front end 510 of the inner selecting unit 500. More specifically, air flowing along the second inner path 328 between the inner selecting unit 500 and the discharge base unit 400 within the discharge base unit 400 may be discharged through the second inner area 318 formed at the front surface 410 of the discharge base unit 400.

The first inner path 326 may be formed in the inner selecting unit 500. Accordingly, air flowing along the first inner path 326 formed in the inner selecting portion 500 may be discharged outside through the first inner area 316 provided in the front end 510 of the inner selecting unit 500.

As shown in FIGS. 5 and 6, when the first inner opening-and-closing portion 440 is rotated to allow the first inner hole 442 to face the second hole 452, the air flowing through the air path 150 may be drawn into the discharge base unit 400 through the first inner hole 442 and the second inner hole 452. As discussed above, the air drawn into the discharge base unit 400 may selectively flow along the first inner path 326 or the second inner path 328.

According to an embodiment, the air discharge unit 300 may be configured to discharge air through one of the first inner area 316 or the second inner area 318 selected based on displacement by the inner selecting unit 500. The inner selecting unit 500 may be configured to rotate or linearly move in the discharge base unit 400 so as to direct air through the first inner area 316 or the second inner area 318.

Referring to FIGS. 5 and 6, the discharge base unit 400 according to an embodiment may be rotatable along the circumferential direction of the main body 100. The inner selecting unit 500 may be movable in the forward-and-backward direction. The air discharge unit 300 may be configured to allow one of the outer area 312 or the inner area 314 to be selected based on a rotational position of the discharge base unit 400 and one of the first inner area 316 and the second inner area 318 to be selected based on a linear position of the inner selecting unit 500.

More specifically, the user may rotate the discharge base unit 400 and select one of the outer path 322 or the inner path 324. After that, the user may move the inner selecting unit 500, in a state in which the inner path 324 is selected, and select one of the first inner path 326 or the second inner path 328.

As discussed above, the plurality of the discharge areas 310 according to an embodiment may include the outer area 312, the first inner area 316 of the inner area 314, and the second inner area 318 of the inner area 314. The outer area 312 may be provided between the front surface 410 provided in the discharge base unit 400 and exposed to the front of the main body 100 and the outer wall 170 of the main body 100 such that air may be discharged from the outer path 322.

The first inner area 316 may be arranged at the front end 510 of the inner selecting unit 500 and configured to discharge air of the first inner path 326. The second inner area 318 may be arranged at the front surface 410 of the discharge base unit 400 and configured to discharge air of the second inner path 328.

The outer area 312 may discharge air through an open surface formed between the outer wall 170 of the main body 100 and the front surface of the discharge base unit 400. The first inner area 316 may discharge air through a hole provided at the front end 510 of the inner selecting unit 500. The second inner area 318 may discharge air through a plurality of through-holes provided in the front surface 410 of the discharge base unit 400.

The air discharge unit 300 may discharge air through one of the outer area 312 or the inner area 314 selected based on the rotational position of the discharge base unit 400, and then discharge air through one of the first inner are 316 or the second inner area 318 selected based on the linear position of the inner selecting unit 500 in a state in which the inner area 314 is selected. More specifically, the inner selecting unit 500 may be movable in the forward and backward direction. Air may flow through the first inner path 326 and the second inner path 328 based on the linear position.

As shown in FIGS. 5 and 6, the discharge base unit 400 may further include a path connecting hole 480. The path connecting hole 480 may be formed in the discharge base unit 400 and configured to facilitate communication between the second inner path 328 and the first inner hole 242.

The inner selecting unit 500 may further include a path extending portion 520. The path extending portion 520 may extend from the front end 510 backwardly through the path connecting hole 480. The second inner path 328 may be formed in the inner selecting unit 500.

In addition, the inner selecting unit 500 may further include a hole closing portion 530. The hole closing portion 530 may be provided in an outer area of the path extending portion 520 and configured to selectively close the path connecting hole 480.

The air discharge unit 300 may be configured to close the second inner path 328 and direct air to the first inner path 326. When the inner selecting unit 500 is moved and the path connecting hole 480 is closed by the hole closing portion 430, the second inner path 328 may be closed and air may flow into the first inner path 326.

The path connecting hole 480 may be located in the discharge base unit 400. For example, a partition wall may be provided in the discharge base unit 400 to cross the first inner hole 442 and the front surface 410. The path connecting hole 480 may be formed on the partition wall.

More specifically, the partition wall may be provided to partition off a space into the second inner path 328 provided in the discharge base unit 400 and the first inner hole 442. The path connecting hole 480 may be provided in the partition wall and configured to facilitate communication between the second inner path 328 and the first inner hole 442. The air discharge unit 300 may be configured to allow the air drawn through the air path 150 of the main body 100 to be drawn from inside of the discharge base unit 400 into the second inner path 328 via the path connecting hole 480 and then to be discharged through the second inner area 318, when the first inner hole 442 and the second inner hole 452 are in communication.

In a state in which the path connecting hole 480 is closed, the air discharge unit 300 may be configured to prevent the air drawn from the air path 150 of the main body 100 from be drawn into the second inner path 328 by the partition wall. More specifically, according to an embodiment, air transferred from the air path 150 may be flow into the second inner path 328 through the path connecting hole 480 from the discharge base unit 400.

The path extending portion 520 may extend in parallel with the forward-and-backward direction, in other words, an air discharging direction or longitudinal direction of the main body 100. The inner selecting unit 500 may be formed to allow the path extending portion 520 to extend from the front end 510 and penetrate the path connecting hole 480.

In a state in which the path connecting hole 480 is open, the air drawn from the air path 150 may flow between an inner circumferential surface of the path connecting hole 480 and the path extending portion 520 to be drawn into the second inner path 328.

A first inner path 326 may be formed in the path extending portion 520 and configured to communicate with a hole of the first inner area 316. The path extending portion 520 may be configured to allow the first inner path 326 to be open at a predetermined point located between the path connecting hole 480 and the first inner hole 442, which will be described hereinafter.

The hole closing portion 530 may protrude outwardly from the path extending portion 520. In other words, the hole closing portion 530 may protrude in a direction that crosses the path extending portion 520 from the path extending portion 520. The hole closing portion 530 may be formed in a ring or disc shape extending along the circumferential direction of the discharge base unit 400.

The hole closing portion 530 may be integrally formed with the path extending portion 520 or fabricated as an independent component to be coupled to the path extending portion 520. The hole closing portion 530 may be linearly movable along the forward-and-backward direction, together with the path extending portion 520.

The hole closing portion 530 may be provided to close the path connecting hole 480 based on its position. In other words, a diameter of a cross section of the hole closing portion 530 may be equal to or larger than a diameter of the path connecting hole 480. The inner selecting unit 500 may be movable for the hole closing portion 530 to close the path connecting hole 480 or contact with the partition wall having the path connecting hole 480 formed therein.

According to an embodiment, the hole closing portion 530 may selectively close the path connecting hole 480 based on movement of the inner selecting unit 500. When the path connecting hole 480 is closed, the second inner path 328 may be closed and air may flow through the first inner path 326 to be discharged through the first inner area 316.

FIG. 5 illustrates that the inner selecting unit 500 is moved to space the hole closing portion 530 apart from the path connecting hole 480 such that air may flow along the second inner path 328. FIG. 6 illustrates that the inner selecting unit 500 is moved to allow the hole closing portion 530 to close the path connecting hole 480 and close the second inner path 328 such that air may flow along the first inner path 326.

In addition, FIG. 11 illustrates the partition wall partitioning off the space inside of the discharge base unit 400 into the first inner hole 442 and the second inner path 328 and the path connecting hole 480 provided in the partition wall. FIG. 12 illustrates the path extending portion 520 and the hole closing portion 530 provided in the inner selecting unit 500.

Referring to FIGS. 5 and 6, the hole closing portion 530 according to an embodiment may be located at a rear of the path connecting hole 480, and the path extending portion 520 may have a path hole 540 that is open towards a rear portion of the hole closing portion 530 to communicate with the first inner path 326.

In addition, the discharge base unit 400 may further include a path closing portion 490. The path closing portion 490 may be provided behind the path hole 540 and configured to selectively close the path hole 540 based on movement of the inner selecting unit 500.

The air discharge unit 300 may be configured to close the first inner path 326 to space the hole closing portion 530 apart from the path connecting hole 480 and direct air into the second inner path 328, when the inner selecting unit 500 is moved to allow the path hole 540 to be closed by the path closing portion 490. More specifically, the path extending portion 520 may extend from the front end 510 of the inner selecting unit 500 backwardly and a rear end of the path extending portion 520 may be located behind the path connecting hole 480. Also, the path extending portion 520 may include the path hole 540 configured to open the first inner path 326 towards a rear area of the hole closing portion 530.

In other words, the first inner path 326 may be in communication with the inside of the discharge base unit 400 via the path hole 540. The path hole 540 may be located behind the path connecting hole 480 and the hole closing portion 530.

The path closing portion 490 may be provided in the discharge base unit 400 behind the path hole 540. The path hole 540 may be open backwardly. When the inner selecting unit 500 is moved backwardly to contact with the path hole 540 and the path closing portion 490, the first inner path 326 may be closed and the second inner path 328 may be open.

FIG. 5 illustrates that the first inner path 326 according to an embodiment is closed and that the second inner path 328 is in communication with the air path 150 to discharge air through the second inner area 318. The inner selecting unit 500 may be moved backwardly to allow the path closing portion 490 to close the path hole 540. As the inner selecting unit 500 is moved backwardly, the hole closing portion 530 located behind the path connecting hole 480 may be spaced apart from the path connecting hole 480 or the partition wall backwardly.

More specifically, as shown in FIG. 5, the path hole 540 is closed by the path closing portion 490 and the inner path 326 is closed. Also, it is shown that the hole closing portion 530 is spaced apart from the path connecting hole 480 to direct air through the second inner path 328.

The path closing portion 490 may be formed in a plate shape and may contact with the path hole 540 to close the path hole 540. Alternatively, as shown in FIG. 5, the path closing portion 490 may include a predetermined space provided behind the hole closing portion 530 and partitioned off by the hole closing portion 530. As shown in FIG. 5, the space of the path closing portion 490 may be closed by the hole closing portion 530 that closely contacts with the front area. The path hole 540 provided in such a space may also have a relationship with the path hole 540 or the air path 150 and then be closed.

FIG. 6 illustrates that the second inner path 328 according to an embodiment is closed and that air is discharged through the first inner area 316 by communication between the first inner path 326 and the air path 150. The inner selecting unit 500 may move forwardly to allow the hole closing portion 530 to close the path connecting hole 480. As the inner selecting unit 500 is moving forwardly, the path hole 540 located in front of the path closing portion 490 may be forwardly spaced apart from the path closing portion 490.

More specifically, as shown in FIG. 6, the path connecting hole 480 may be closed by the hole closing portion 530 to close the second inner path 328. The path hole 540 or the hole closing portion 530 may be spaced apart from the path closing portion 490 to direct air along the first inner path 326.

FIG. 11 illustrates that the path closing portion 490 is provided in the discharge base unit 400 according to an embodiment. FIG. 12 illustrates that the path hole 540 is provided in the inner selecting portion 500.

Referring to FIGS. 5 and 6, the air discharge unit 300 according to an embodiment may further include a location adjusting unit (location adjuster) 590. The location adjusting unit 590 may be provided in the rotation coupling portion 460 and configured to adjust a location of the inner selecting unit 500 based on the forward-and-backward direction.

The inner selecting unit 500 may further include an inner moving portion 550 and an inner connecting portion 560. The inner moving portion 550 may be provided in the rotation coupling portion 460 and configured to be movable along the forward-and-backward direction by the location adjusting portion 590. The inner connecting portion 560 may be configured to connect the inner moving portion 550 with the path extending portion 520.

The location adjusting portion 590 may be provided in the rotation coupling portion 460 of the discharge base unit 400. The location adjusting portion 590 may be provided at a rear end of the discharge base unit 400. The rotation coupling portion 460 may be located in the base accommodating portion 470 and the location adjusting portion 590 may be arranged in the rotation coupling portion 460. FIG. 9 illustrates that the location adjusting portion 590 is separated from the rotation coupling portion 460. FIG. 12 illustrates that the location adjusting portion 590 is provided in the rotation coupling portion 460.

The location adjusting portion 590 may be configured to adjust the location of the inner selecting unit 500. The location adjusting portion 590 according to an embodiment may be linearly movable along the forward-and-backward direction, the longitudinal direction of the main body 100, or the air discharge direction. The location adjusting portion 590 may be configured to linearly move the inner selecting unit 500.

The location adjusting unit 590 may include a flexible member provided to press or move the inner selecting unit 500 forwardly. The inner selecting unit 500 may be forwardly moved by the flexible member.

The location adjusting portion 590 may include a fixing portion configured to fix a position of the inner selecting unit 500. For example, the user may backwardly press or move the inner selecting unit 500 according to an embodiment. The inner selecting unit 500 moved backwardly may be secured in the location by means of the fixing portion of the location adjusting portion 590. The inner selecting unit 500 may be forwardly moved by the flexible member as the securing is released by the user's additional manipulation.

The location adjusting portion 590 may include the flexible member and further include a pressing member provided between the flexible member and the inner selecting unit 500. The pressing member may be fixed by the fixing portion. The fixing unit may be provided as a hook type or a groove. The location of the pressing member backwardly moved together with the inner selecting unit backwardly moved may be fixed by the hook or groove. Alternatively, the inner selecting unit 500 may be fixed by the fixing portion directly.

When the fixing portion includes an auxiliary shape, such as a hook or groove, the pressing member or the location adjusting portion 590 may be released and the pressing member forwardly moved by the flexible member to move the inner selecting unit 500 forwardly. Accordingly, the inner selecting unit 500 may be secured in a first position or moved to a second position, even where the user does not directly move the inner selecting unit 500, and thus, user convenience may be improved.

The inner moving portion 550 may be provided behind the path extending portion 520 or the hole closing portion 530 of the inner selecting unit 500 and then connected with the location adjusting portion 590. In other words, the inner selecting unit 500 according to an embodiment may move the path extending portion 520 and the hole closing portion 530 forwardly as the inner moving portion 550 is moved by the flexible member or the pressing member of the location adjusting portion 590 forwardly.

More specifically, the inner moving portion 550 may be the means coupled to the location adjusting portion 590 and configured to provide the inner selecting unit 500 with moving power transmitted by the location adjusting portion 590. FIG. 5 illustrates that the inner selecting unit 500 according to an embodiment is moved backwardly and that the flexible member of the location adjusting portion 590 is compressed. FIG. 6 illustrates that the inner selecting unit 500 is moved forwardly and that the flexible member of the location adjusting portion 590 is elastically restored.

FIGS. 5 and 6 illustrate the location adjusting portion 590 that includes the flexible member according to an embodiment; however, embodiments are not limited thereto. The location adjusting portion 590 may be a motor or other diverse type that may linearly move the inner selecting unit 500.

The inner connecting portion 560 may be configured to connect the inner moving portion 550 with the path extending portion 520. The inner connecting portion 560 may extend from the hole closing portion 530 or the path extending portion 530 backwardly. The shape of the inner connecting portion 560 may be variable.

FIG. 9 illustrates a plurality of inner connecting portions having a bar shape extending from the hole closing portion 530 or the path extending portion 520 backwardly according to an embodiment and that the inner moving portion 550 is provided at a rear end of the inner connecting portion 560.

The plurality of the inner connecting portions 560 may be provided and spaced apart from each other along the circumferential direction of the main body 100 or the discharge base unit 400 such that air may be drawn into the path hole 540 provided in the path extending portion 520.

The inner selecting unit 500 according to an embodiment may further include a flow guide portion (flow guide) 570. The flow guide portion 570 may be provided at the front end 510 of the inner selecting unit 500 and extend from the hole forwardly to increase a cross-sectional area towards the front.

FIG. 9 illustrates the flow guide portion 570 that is provided at the front end 510 of the inner selecting unit 500 according to an embodiment. FIG. 3 illustrates the flow guide portion 570 that is exposed from the front surface 410 of the discharge base unit 400 forwardly.

The flow guide portion 570 may form the first inner area 316. In other words, the first inner area 316 may be defined in the front end 510 of the inner selecting unit 500 by the flow guide portion 570.

The flow guide portion 570 may forwardly extend from the hole provided in the front end 510 of the inner selecting unit 500 and configured to guide the flow of the air discharged from the hole. The flow guide portion 570 may have the shape that increases the cross-sectional area towards the front end.

Accordingly, flow of air discharged to the first inner area 316 may be further dispersed by the flow guide portion 570 to be provided to the user. Accordingly, the airflow may have a larger cross-sectional area than the hole provided at the front end 510 of the inner selecting unit 500.

According to an embodiment, the air having respective different gas characteristics may be discharged to the user through the outer area 312, the first inner area 316, and the second inner area 318. Accordingly, user convenience may be improved.

In addition, as the outer path 322, the first inner path 326 and the second inner path 328 may be provided, corresponding to the plurality of the discharge areas 310, flow of air having respective different gas characteristics may be effectively formed and user convenience may be enhanced.

Further, as the discharge base unit 400 and the inner selecting unit 500 are provided in the main body 100 according to an embodiment, the user may be provided with diverse kinds of air without inconvenience of mounting or demounting auxiliary nozzles or elements to or from the main body 100.

Still further, the plurality of the discharge paths 320 may be effectively realized using limited space formed in the main body 100 including the discharge base unit 400 and the inner selecting unit 500.

The user may efficiently select one discharge area 310 and the discharge path 320 by simple manipulation of the discharge base unit 400 and the inner selecting unit 500. Accordingly, user convenience may be further enhanced.

Accordingly, embodiments disclosed herein address the above-noted and other problems of conventional hair dryers.

Embodiments disclosed herein provide a hair dryer that a user may use while adjusting characteristics of the air discharged from a main body simply and advantageously. Further, embodiments disclosed herein provide a hair dryer configured to discharge air to a user via a plurality of paths having respective different air characteristics. Furthermore, embodiments disclosed herein provide a hair dryer that may facilitate simple selection of one path that is effectively formed out of the paths.

A hair dryer according to embodiments disclosed herein may additionally include diverse nozzles to select and use a desired air by changing nozzles based on a hair condition or a use purpose. However, a user might feel inconvenient, because the user has to change the nozzle every time a hair condition or use purpose is changed.

Accordingly, embodiments disclosed herein provide a hair dryer having a variable path structure configured to allow the user to easily change a type of discharged air or wind. An air discharge unit of a hair dryer according to an embodiment may provide at least three discharge paths.

A circular discharge portion of the air discharge unit may discharge air through a thin circular slit while keeping linear flow after passing a heater provided in the main body. A disc-shaped discharge portion of the air discharge unit may discharge air through a disc having a micro-hole through another path formed in the path communicating with the circular discharge portion after passing through the heater.

The air discharge unit may be rotated a preset or predetermined angle (e.g., 90 degrees) to select the disc-shaped discharge portion in a state in which the circular discharge portion is selected.

A center-concentrated discharge portion of the air discharge unit may press a center square nozzle unit in the disc-shaped discharge portion and change the position to be selected. The center-concentrated discharge portion may discharge air through the nozzle unit after the air flows through a path additionally formed in the path connected with the disc-shaped discharge portion after passing through the heater.

The user may simply change the air flow type by the user's simple manipulation of the air discharge unit provided in the main body. Accordingly, inconvenience of nozzle change may be solved and the air having at least three different gas characteristics may be provided.

According to one embodiment, the following structure may be provided with the hair dryer to realize the plurality of the paths. First, several holes may be formed in a center of a circular path to change the direction of the path for discharging air in a circular shape towards the center.

An auxiliary rotatable center path structure having a shape for closing or opening a circular path while facing a hole of the circular path may be attached. the rotatable center path structure may be rotatable and the path direction may be changed to the center path by closing the hole of the circular path based on a rotational angle.

A linear center path structure may be provided in the rotatable center path structure. The linear center path structure may be linearly movable and form a path in an inner area by changing the flow direction of the air drawn into the rotatable center path based on the position. The linear center path structure may be connected with an auxiliary element to facilitate the linear moving and pausing.

It will be apparent to those skilled in the art that various modifications and variations can be made in the present disclosure without departing from the spirit or scope of the disclosures. Thus, it is intended that embodiments cover modifications and variations of this disclosure provided they come within the scope of the appended claims and their equivalents.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hair dryer, comprising:

a main body comprising a discharge unit configured to discharge fluid outside of the main body; and a handle provided at one side of the main body, wherein the discharge unit comprises a plurality of discharge areas configured to discharge fluid, wherein the discharge unit is configured to selectively discharge fluid through one of plurality of the discharge areas, wherein the plurality of the discharge areas comprises:

an outer area arranged at a front surface of the main body and formed in a ring shape extending along a circumferential direction of the main body; and an inner area provided at the front surface of the main body and arranged within the outer area, wherein the discharge unit comprises:

a discharge base inserted into the main body and having a front surface that forms the front surface of the main body, wherein the outer area is configured to surround the front surface of the discharge base along the circumferential direction, and wherein the inner area is arranged on the front surface of the discharge base, wherein the discharge unit is configured to discharge fluid through one of the inner area or the outer area selected based on a displacement of the discharge base, wherein the inner area comprises:

a first inner area arranged at a center of the front surface provided in the main body; and a second inner area arranged between the first inner area and the outer area and surrounding the first inner area and provided at the front surface and surrounding the first inner area along the circumferential direction, and wherein the discharge unit is configured to discharge fluid through one area selected from the outer area, the first inner area, and the second inner area, and wherein the discharge unit is configured to discharge fluid through one area selected from the first inner area or the second inner area in a state in which the inner area is selected by rotation of the discharge base.

2. The hair dryer of claim 1, wherein the outer area is configured to discharge fluid through an open surface formed between the front surface of the discharge base and the main body.

3. The hair dryer of claim 1, further comprising:

an inner selector inserted into the discharge base and having a front end exposed at a front of the front surface, wherein the first inner area is provided at the front end of the inner selector and the second inner area is provided at the front surface of the discharge base.

4. The hair dryer of claim 3, wherein the discharge unit is configured to discharge fluid through one area selected from the first inner area or the second inner area based on displacement of the inner selector.

5. The hair dryer of claim 4, wherein the discharge base is rotatable along the circumferential direction and the inner selector is movable in a linear direction, and wherein the discharge unit is configured to allow one of the outer area or the inner area to be selected based on a rotational position of the discharge base and allow one of the first inner area or the second inner area to be selected based on a linear position of the inner selector.

6. The hair dryer of claim 3, wherein the first inner area is configured to discharge fluid through a hole provided at the front end of the inner selector, and wherein the second inner area is configured to discharge fluid through a plurality of through-holes provided in the front surface of the discharge base.

7. The hair dryer of claim 6, wherein the inner selector comprises:

a flow guide provided at the front end of the inner selector and having an inner diameter that increases towards the front.

* * * * *